US012419482B1

(12) United States Patent
Lin

(10) Patent No.: US 12,419,482 B1
(45) Date of Patent: Sep. 23, 2025

(54) MOP CLEANING DEVICE

(71) Applicant: Shengchao Lin, Yongkang (CN)

(72) Inventor: Shengchao Lin, Yongkang (CN)

( * ) Notice: Subject to any disclaimer, the term of this patent is extended or adjusted under 35 U.S.C. 154(b) by 0 days.

(21) Appl. No.: 19/173,829

(22) Filed: Apr. 9, 2025

(30) Foreign Application Priority Data

Jul. 17, 2024 (CN) ..... 202421697726.0

(51) Int. Cl.
*A47L 13/59* (2006.01)

(52) U.S. Cl.
CPC ..... *A47L 13/59* (2013.01)

(58) Field of Classification Search
CPC ..... A47L 13/58; A47L 13/59
USPC ..... 15/116.1, 119.1, 260, 261, 262
See application file for complete search history.

(56) References Cited

FOREIGN PATENT DOCUMENTS

| | | | | |
|---|---|---|---|---|
| CN | 212661770 U | 3/2021 | | |
| CN | 213155721 U | 5/2021 | | |
| CN | 213640767 U | 7/2021 | | |
| CN | 217610946 U | 10/2022 | | |
| WO | WO-2024110010 A1 * | 5/2024 | ..... | A47L 13/22 |

* cited by examiner

*Primary Examiner* — Tom Rodgers
(74) *Attorney, Agent, or Firm* — Nitin Kaushik

(57) ABSTRACT

The present invention discloses a mop cleaning device, including a bucket body, where a squeezing chamber and a water storage chamber for cleaning or dewatering of a mop are disposed in the bucket body, a squeezing mechanism is disposed on the bucket body, a water supply mechanism is disposed in the water storage chamber, the water supply mechanism is communicated to the squeezing mechanism, the water supply mechanism includes a water pump disposed in the water storage chamber, a retractor disposed on the squeezing mechanism, and a sliding assembly disposed along an inner side wall of the squeezing chamber in an up-and-down movement manner, the sliding assembly is connected to the retractor, and the retractor is connected to the water pump through a transmission assembly.

7 Claims, 7 Drawing Sheets

MOP CLEANING DEVICE

CROSS-REFERENCE TO RELATED APPLICATIONS

The application claims priority to Chinese patent application No. 2024216977260, filed on Jul. 17, 2024, the entire contents of which are incorporated herein by reference.

TECHNICAL FIELD

The present invention relates to the technical field of cleaning utensils, and in particular, to a mop cleaning device.

BACKGROUND

It is known that cleaning is a necessary task in daily life, and how to make cleaning effective and fast represents the development trend of current cleaning tools.

A flat mop includes a mop rod and a flat mop head that are hinged together, and a flat mop wiper is fixed on the flat mop head by means of sleeving, pasting, or snap-fastening. When in use, the wiper on the flat mop can fully adhere to the ground, making it very convenient to clean the ground. Moreover, when cleaning, the wiper can also be easily removed or placed in a bucket for cleaning, making such design be favored by people. However, the ease of operation and cleaning of the flat mop have always been manufacturing challenges.

Thus, there appeared, for example, a Chinese Invention Patent with Authorized Announcement No. CN217610946U, which discloses a mop cleaning device with decontamination and drainage functions. The mop cleaning device includes a transmission assembly of a water supply mechanism located on a bucket body, where the transmission assembly includes a transmission wheel and a driven gear in transmission connection with the transmission wheel, the driven gear is connected to a connecting rod assembly, one end of the connecting rod assembly is eccentrically disposed on the driven gear, the other end of the connecting rod assembly is connected to a water pump, a one-way transmission device is disposed between the transmission wheel and the driven gear, and the one-way transmission device is a helical gear or a one-way bearing. In this embodiment, the one-way transmission device is the helical gear. The helical gear is engaged with internal teeth of the transmission wheel to control one-way transmission output of the transmission wheel. A rack capable of driving the transmission wheel is disposed on a mop head, transmission teeth are disposed on the transmission wheel, and the rack is engaged with the transmission teeth to drive the transmission wheel, which can realize that the mop moves to drive operation of the transmission wheel. The connecting rod assembly includes a driving rod and a connecting rod, one end of the driving rod is eccentrically disposed on the driven gear, the other end of the driving rod is connected to the connecting rod, and the other end of the connecting rod is connected to the water pump for driving. By utilizing the engagement transmission of the gear, higher transmission accuracy can be ensured, and water output can be more accurately controlled; and by disposing the connecting rod assembly, the driving effect on the water pump can be ensured, water outlet operation can be guaranteed, and excessive water flow can also be avoided.

It can be seen that such transmission assembly not only requires a transmission wheel and a driven gear, but also needs a one-way transmission device. Moreover, such transmission assembly requires a plurality of gears to perform engagement transmission between each other. This greatly increases the difficulty in production, manufacturing, and installation, further increases the cost investment, and is not conducive to the mass production and manufacturing performed by manufacturing enterprises.

SUMMARY

(I) Technical Problems to be Solved

Aiming at the shortcomings of the prior art, the present invention provides a mop cleaning device, which is rational in design, ends the use of gear transmission modes, greatly reduces the difficulty in production and manufacturing, is conducive to reducing the cost investment, and is more in line with production requirements of manufacturing enterprises.

(II) Technical Solution to be Adopted

To achieve the above purpose, the present invention adopts the following technical solution:

A mop cleaning device, including a bucket body, where a squeezing chamber and a water storage chamber for cleaning or dewatering of a mop are disposed in the bucket body, a squeezing mechanism is disposed on the bucket body, a water supply mechanism is disposed in the water storage chamber, the water supply mechanism is communicated to the squeezing mechanism, the water supply mechanism includes a water pump disposed in the water storage chamber, a retractor disposed on the squeezing mechanism, and a sliding assembly disposed along an inner side wall of the squeezing chamber in an up-and-down movement manner, the sliding assembly is connected to the retractor, and the retractor is connected to the water pump through a connecting rod member.

Preferably, the retractor includes a mounting base disposed on a lower end face of the squeezing mechanism, a rotating arm is disposed in the mounting base, the rotating arm is provided with a spring rope, the spring rope is wrapped around the rotating arm, the other end of the spring rope is disposed on the sliding assembly, and the connecting rod member is disposed on the rotating arm.

Preferably, the rotating arm includes a rotating rod and a turntable disposed on an end face of the rotating rod, the rotating rod is located in the mounting base, the turntable is located on an end face of the mounting base, and a fixing base for connecting the connecting rod member is disposed on the turntable.

Preferably, the rotating rod, the turntable, and the fixing base are integrally molded.

Preferably, a cylinder body for mounting the rotating arm is disposed between the mounting base and the rotating arm, and the mounting base and the cylinder body are each provided with an access hole for the spring rope to enter and exit.

Preferably, the sliding assembly includes a sliding base that is disposed on an inner side wall of the squeezing chamber and can slide up and down, the spring rope is fixedly connected to the sliding base, and the sliding base is provided with a groove.

Preferably, the inner side wall of the squeezing chamber is provided with a track groove for the sliding assembly to slide up and down.

Preferably, an abutment plate capable of abutting against a mop rod joint in the mop is mounted in the groove.

Preferably, the water pump is provided with a water inlet end and a water outlet end, the water inlet end is located in the water storage chamber, a water channel is disposed at the water outlet end, and the water channel is communicated to the squeezing mechanism.

Preferably, the water channel and the water storage chamber are integrally molded, the water outlet end of the water pump is disposed at one end of the water channel, and the water channel is communicated to the squeezing mechanism.

Preferably, the squeezing mechanism includes an upper cover disposed on the bucket body, the upper cover is provided with a squeezing opening and a squeezer, a waterway pipe communicated to the water pump is disposed on a lower surface of the upper cover, the upper cover is provided with a water spraying part, and the water spraying part is communicated to the waterway pipe.

Preferably, a cover plate is disposed on the upper cover above the squeezer, and the water spraying part is formed between the cover plate and the squeezer.

Preferably, the upper cover is provided with a handle capable of being conveniently carried by a user.

(III) Technical Effects to be Achieved

Compared to the prior art, the present invention has the following beneficial effects:

First, the water supply mechanism according to the present invention includes a water pump disposed in the water storage chamber, a retractor disposed on the squeezing mechanism, and a sliding assembly disposed along an inner side wall of the squeezing chamber in an up-and-down movement manner, the sliding assembly is connected to the retractor, and the retractor is connected to the water pump through a connecting rod member. Such structure is rational in design, ends the use of gear transmission modes, greatly reduces the difficulty in production and manufacturing, is conducive to reducing the cost investment, and is more in line with production requirements of manufacturing enterprises.

Second, the retractor includes a mounting base disposed on a lower end face of the squeezing mechanism, a rotating arm is disposed in the mounting base, the rotating arm is provided with a spring rope, the spring rope is wrapped around the rotating arm, the other end of the spring rope is disposed on the sliding assembly, and the connecting rod member is disposed on the rotating arm. The retractor disposed in such manner has the effect of random retraction, and facilitates the sliding assembly to slide up and down, thereby achieving water spraying and better facilitating the cleaning of the mop.

Third, the sliding assembly according to the present invention includes a sliding base that is disposed on an inner side wall of the squeezing chamber and can slide up and down, the spring rope is fixedly connected to the sliding base, the sliding base is provided with a groove, and sliding wheels for sliding are disposed on the sliding base on a side edge of the groove. Such disposing manner is more rational, and up and down sliding of the sliding assembly is operated by a process that the retractor controls the water pump to pump water.

Figure 1:
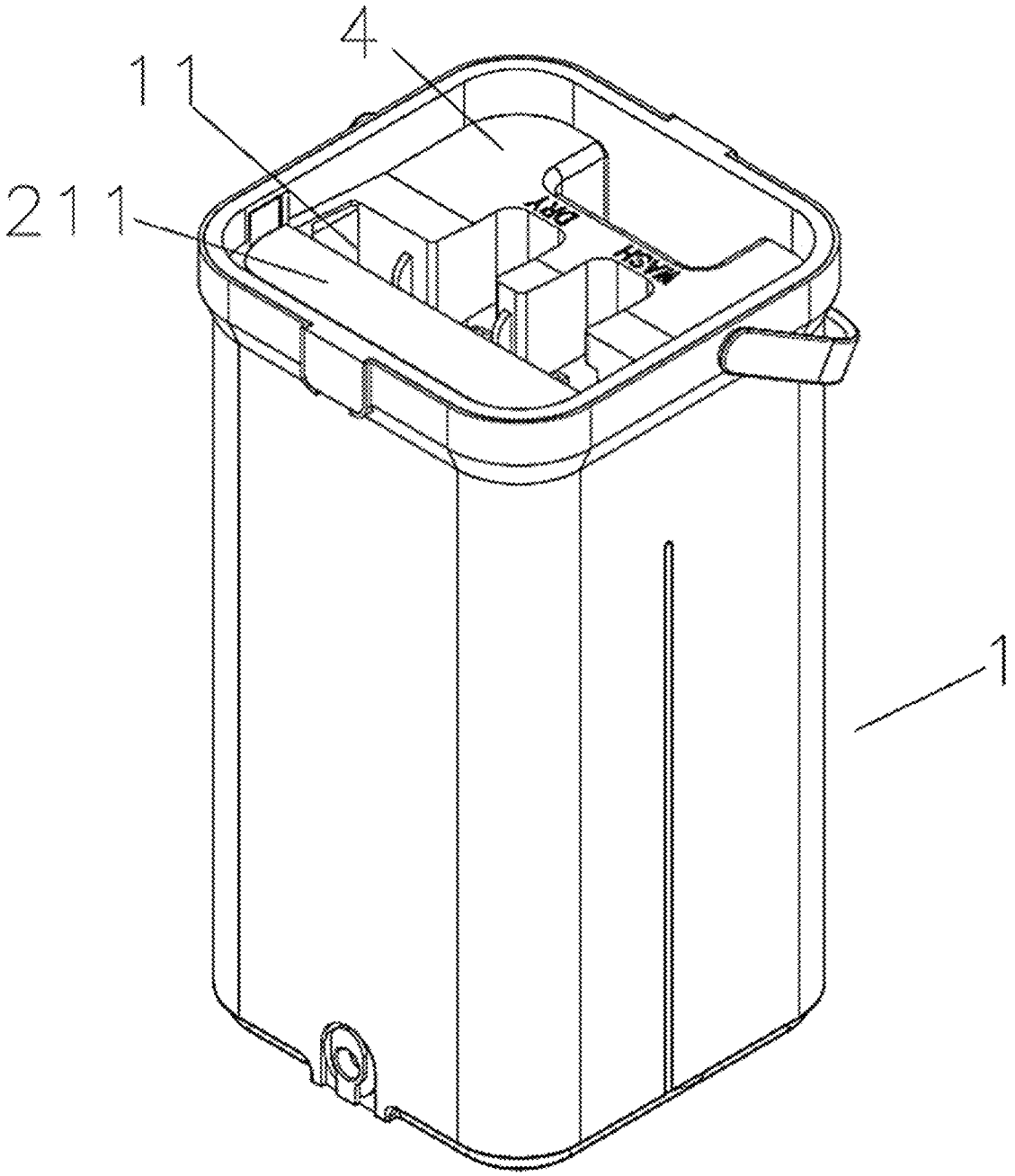
FIG. 1 is an overall schematic diagram of the present invention.

In the figures: 1. bucket body; 2. mop; 3. water supply mechanism; 4. squeezing mechanism; 11. squeezing chamber; 12. water storage chamber; 21. upper cover; 22. squeezing opening; 23. squeezer; 24. waterway pipe; 25. water spraying part; 26. handle; 31. water pump; 32. retractor; 33. sliding assembly; 34. connecting rod member; 211. cover plate; 311. water inlet end; 312. water outlet end; 313. water channel; 321. mounting base; 322. rotating arm; 323. spring rope; 324. cylinder body; 331. sliding base; 332. groove; 333. sliding wheel; 334. abutment plate.

DETAILED DESCRIPTION OF THE EMBODIMENTS

In the description of the present invention, it should be noted that, when an element is described to be "fixed to" or "disposed on" another element, it may be directly positioned on another element or indirectly positioned on another element. When an element is described to be "connected to" another element, it may be directly connected to another element or indirectly connected to another element.

In the description of the present invention, it should be noted that the orientations or positional relationships indicated by the terms "center", "length", "width", "thickness", "up", "down", "front", "back", "left", "right", "vertical", "horizontal", "top", "bottom", "inside", "outside", etc. are in accordance with those shown in the accompanying drawings, or refer to orientations or positional relationships in which a product of the invention is typically placed when in use, and are intended only for the convenience of describing the present invention and simplifying the description rather than for indicating or implying that the referred device or element must be provided with a particular orientation or constructed and operated in a particular orientation; therefore, they should not be construed as limiting the present invention. Furthermore, the terms "first", "second", "third" are merely used for the purpose of distinguishing description and should not be construed as indication or implication of relative importance. Therefore, features defined by "first" and "second" may explicitly or implicitly include one or more of such features. In the description of the present invention, the meaning of "plurality of" is at least two, unless otherwise specifically defined. The meaning of "several" is one or more, unless otherwise specifically defined.

In the description of the present invention, it should be further noted that unless otherwise expressly specified and defined, the terms "disposed", "mounted", "attached", "connected" should be understood in a broad sense, e.g., it may be a fixed connection, a detachable connection or an integral connection; it may be a mechanical connection; it may be a direct attachment, or an indirect attachment through an intermediate medium; and it may be a communication within two elements. For those of ordinary skill in the art, the specific meanings of the above terms in the present invention may be understood based on specific circumstances.

To make the purpose, technical solutions, and advantages of the present invention clearer and more apparent, the present invention is further described below in detail through the accompanying drawings and embodiments. However, it should be understood that specific embodiments described herein are only used to interpret the present invention and are not intended to limit the scope of the present invention. Furthermore, in the following description, descriptions of well-known structures and techniques have been omitted to avoid unnecessary confusion of the concepts of the present invention.

Figure 2:
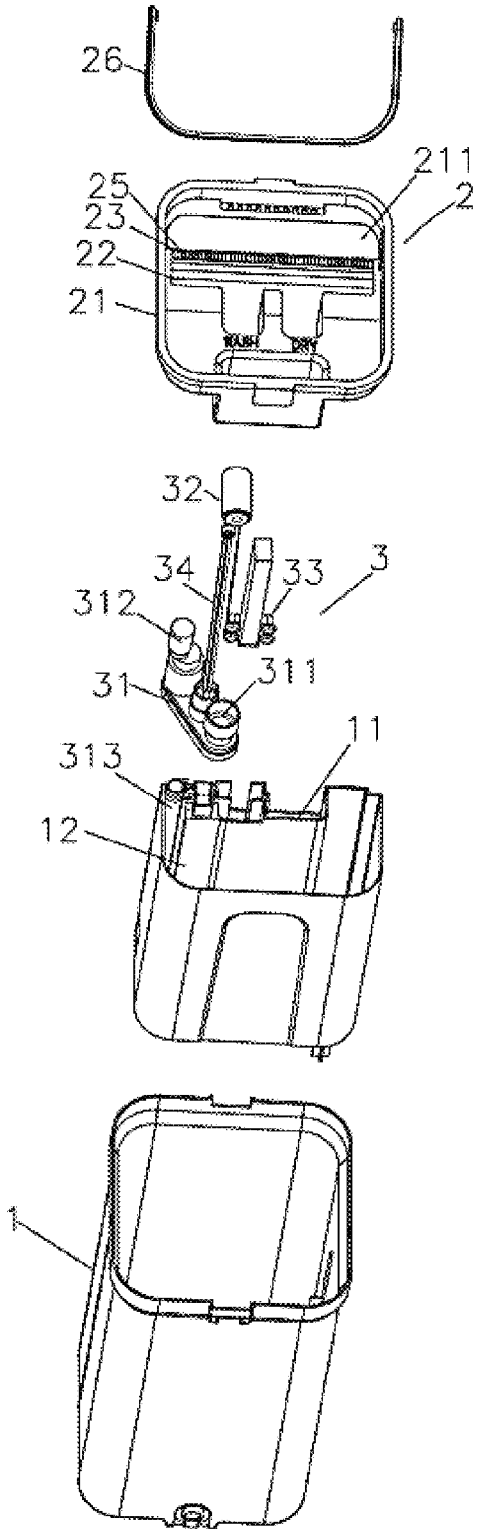
FIG. 2 is an exploded schematic diagram of the present invention.
Figure 5:
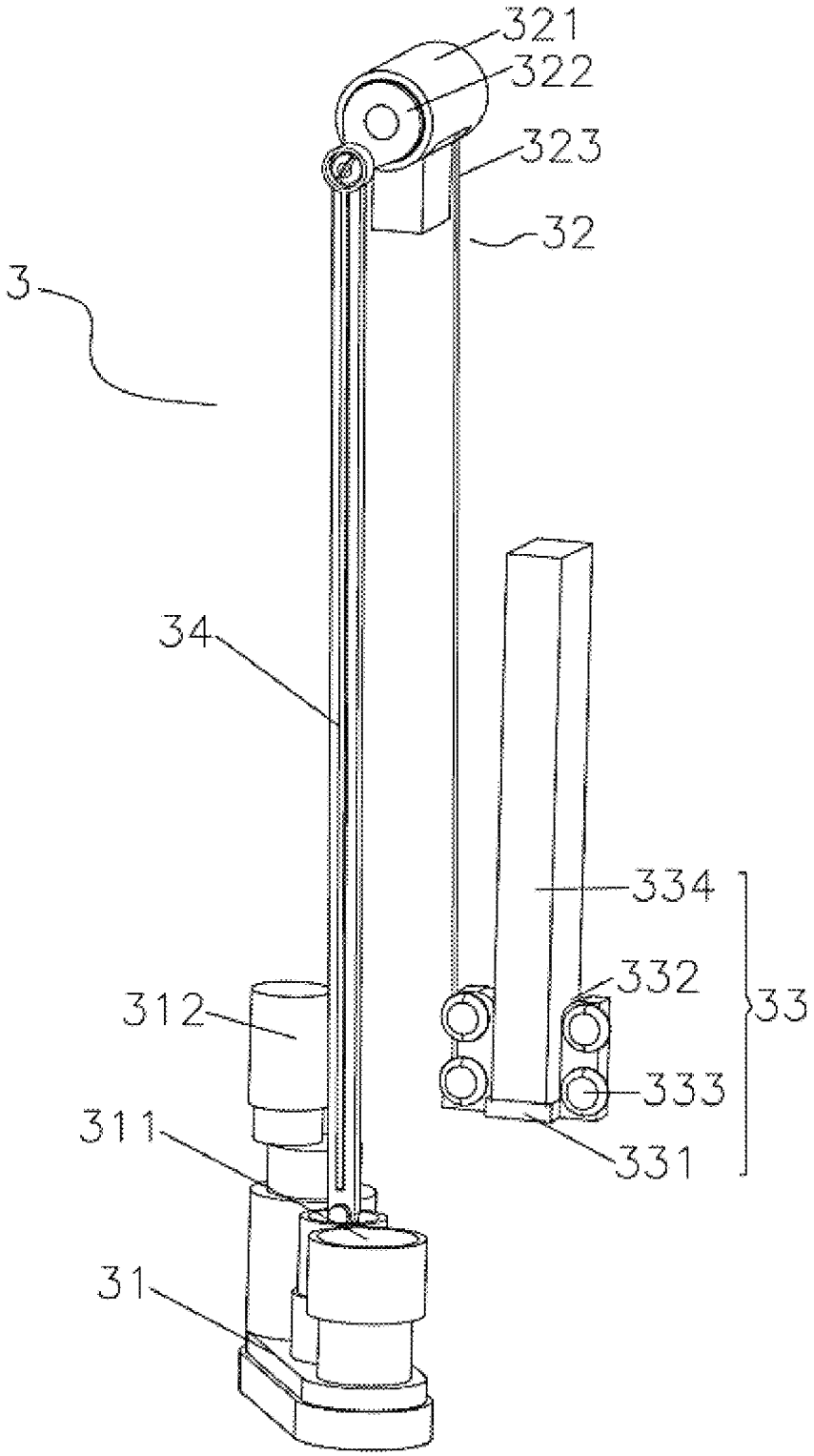
FIG. 5 is a schematic structural diagram of a water supply mechanism of the present invention.
Figure 6:
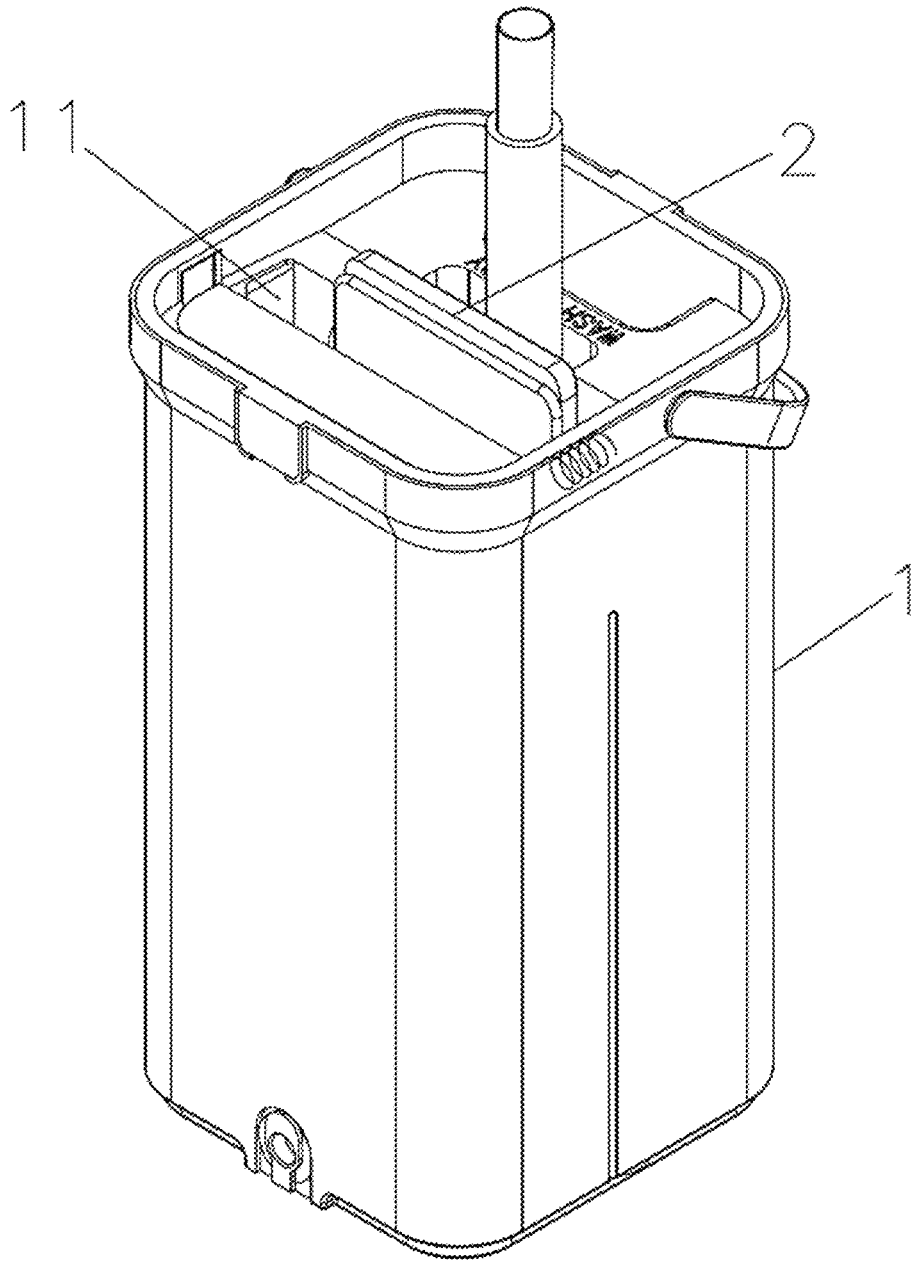
FIG. 6 is a schematic diagram of a first state in which the present invention is used in conjunction with a mop.
Figure 7:
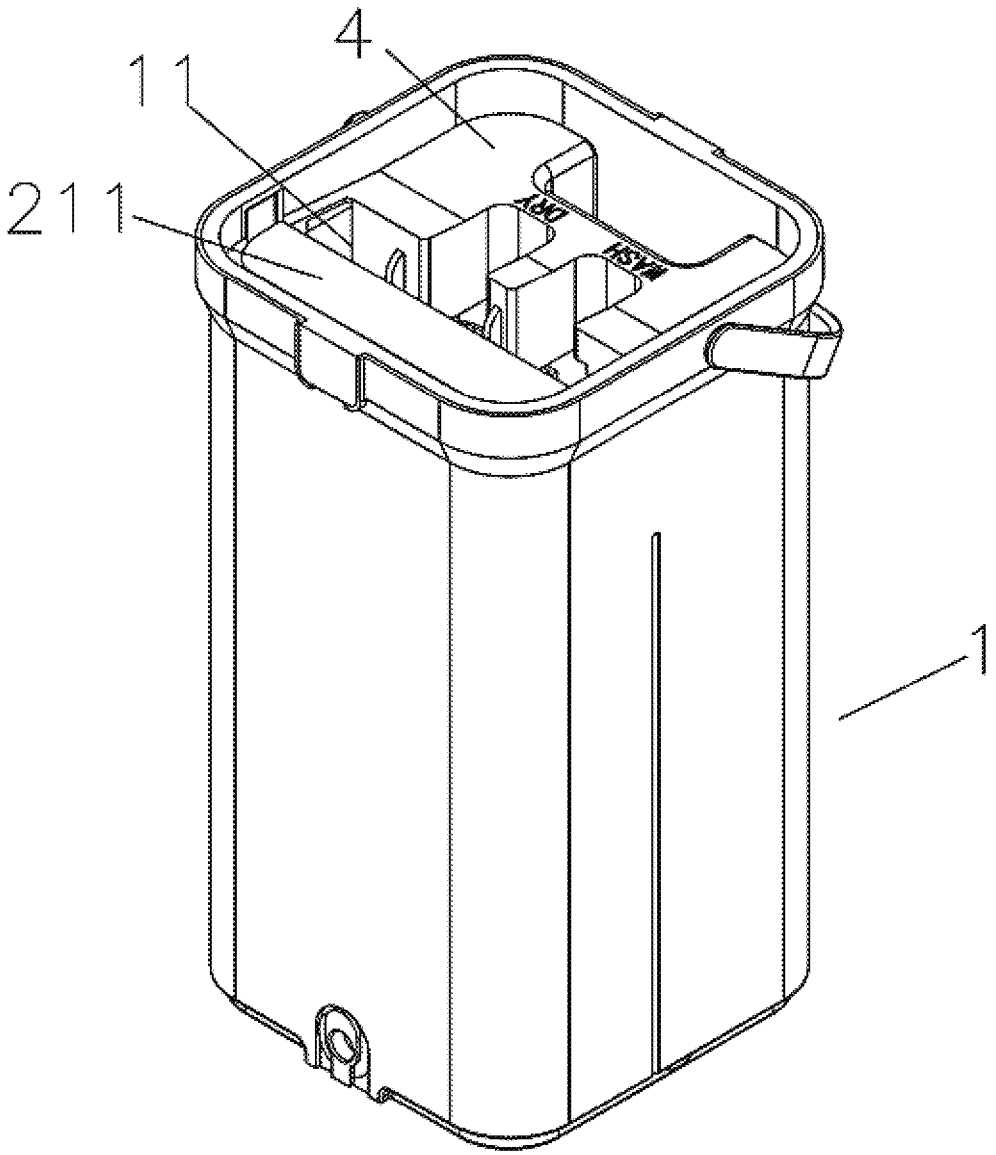
FIG. 7 is a schematic diagram of a second state in which the present invention is used in conjunction with a mop.

Embodiment I: referring to FIG. 1, FIG. 2, and FIG. 5, a mop cleaning device includes a bucket body 1, where a squeezing chamber 11 and a water storage chamber 12 for cleaning or dewatering of a mop 2 are disposed in the bucket body 1, a squeezing mechanism 4 is disposed on the bucket body 1, a water supply mechanism 3 is disposed in the water storage chamber 12, the water supply mechanism 3 is communicated to the squeezing mechanism 4, the water supply mechanism 3 includes a water pump 31 disposed in the water storage chamber 12, a retractor 32 disposed on the squeezing mechanism 4, and a sliding assembly 33 disposed along an inner side wall of the squeezing chamber 11 in an up-and-down movement manner, the sliding assembly 33 is connected to the retractor 32, and the retractor 32 is connected to the water pump 31 through a connecting rod member 34. As shown in FIG. 6 and FIG. 7, the mop 2 passes through the squeezing mechanism 4 during cleaning and causes the sliding assembly 33 to reciprocally move up and down, the sliding assembly 33 is linked with the connecting rod member 34 through the retractor 32, the connecting rod member 34 will be linked with the water pump 31, and thus the mop 2 can be cleaned by the water pump 31 through water spraying. The mop cleaning device is rational in overall structural configuration, is easy for users to operate and use, saves water, and is more labor-saving during use. The up and down movement of the mop 2 drives the sliding assembly 33, thereby driving the water pump 31 to discharge water, and thus automatic water discharge can be achieved during the cleaning process of the mop 2. In this way, the mop 2 can be cleaned and dewatered synchronously, which helps the users to save the use time, avoids a previous operation of cleaning in a cleaning area first and then dewatering in a dewatering area, is more convenient for the users to operate and use, and simplifies an internal structural configuration.

As shown in FIG. 1, FIG. 2, FIG. 5, FIG. 6, and FIG. 7, pistons are disposed on the bucket body 1 and the squeezing chamber 11, which facilitates the discharge of water. The piston on the squeezing chamber 11 facilitates the discharge of sewage, while the piston on the bucket body 1 (not shown in the figures) facilitates the discharge of residual water, avoiding discharge failure caused by water accumulation.

Embodiment II: this embodiment can be illustrated on the basis of Embodiment I. As shown in FIG. 2, FIG. 3, FIG. 4, and FIG. 5, the retractor 32 includes a mounting base 321 disposed on a lower end face of the squeezing mechanism 4, a rotating arm 322 is disposed in the mounting base 321, the rotating arm 322 is provided with a spring rope 323, the spring rope 323 is wrapped around the rotating arm 322, the other end of the spring rope 323 is disposed on the sliding assembly 33, and the connecting rod member 34 is disposed on the rotating arm 322. In this way, after the sliding assembly 33 is driven to slide downwards, the spring rope 323 wrapped around the rotating arm 322 is pulled out, and then the rotating arm 322 can self-rotate. The rotational movement of the rotating arm 322 drives the connecting rod member 34 to move back and forth, finally driving the water pump 31 to discharge water, and thus automatic water discharge can be achieved during the cleaning process of the mop 2. As a further illustration, the rotating arm 322 includes a rotating rod and a turntable disposed on an end face of the rotating rod, the rotating rod is located in the mounting base 321 and can perform rotational movement in the mounting base 321, the turntable is located on an end face of the mounting base 321, and a fixing base for connecting the connecting rod member 34 is disposed on the turntable. Such configuration is rational, and moreover, the rotating rod, the turntable, and the fixing base are integrally molded, which greatly improves the firmness of the structure. Since the spring rope 323 has a retraction effect, it can be pulled out when in use and can be automatically wrapped around the rotating arm 322 when not in use, which is conducive to meeting the use requirements.

Figure 3:
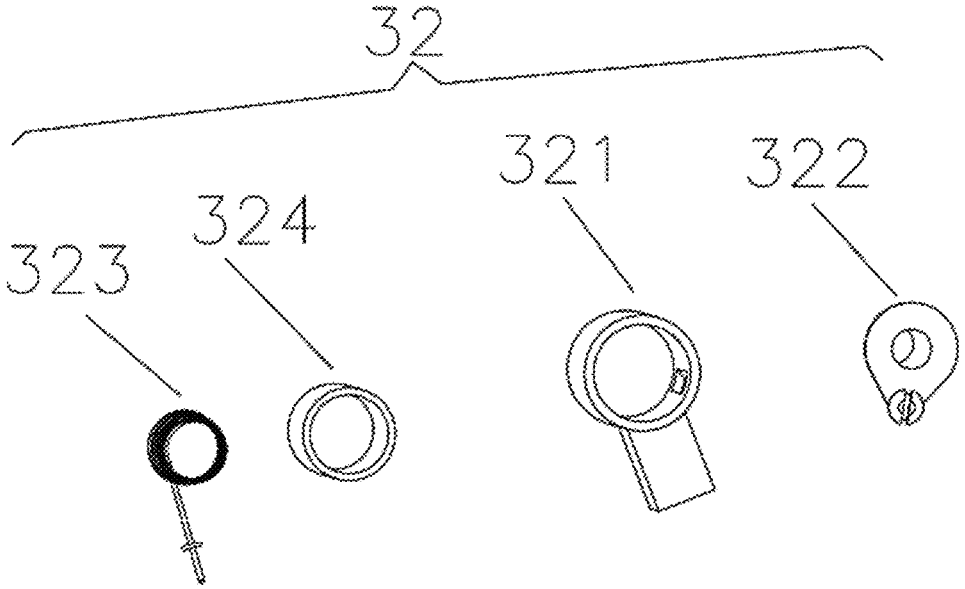
FIG. 3 is an exploded schematic diagram of a retractor of the present invention.
Figure 4:
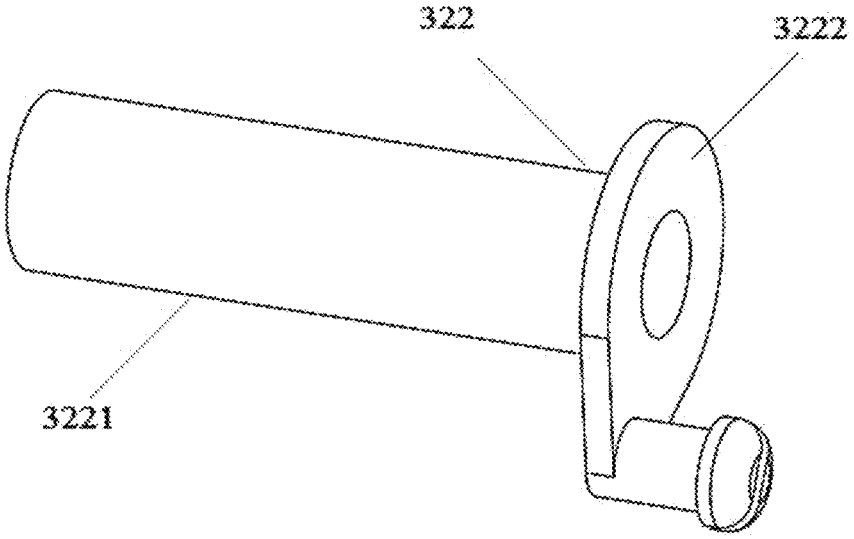
FIG. 4 is a schematic structural diagram of a rotating arm of the present invention.

As shown in FIG. 3, a cylinder body 324 for mounting the rotating arm 322 is disposed between the mounting base 321 and the rotating arm 322, the rotating arm 322 can perform rotational movement in the cylinder body 324, and the mounting base 321 and the cylinder body 324 are each provided with an access hole for the spring rope 323 to enter and exit, which facilitates entry and exit of the spring rope 323.

As shown in FIG. 5, the sliding assembly 33 includes a sliding base 33 that is disposed on an inner side wall of the squeezing chamber 11 and can slide up and down, the spring rope 323 is fixedly connected to the sliding base 33, the up and down movement of the sliding base 33 drives the spring rope 323 to be retracted, and the sliding base 331 is provided with a groove 332. It is preferred that sliding wheels 333 for sliding are disposed on the sliding base 331 on a side edge of the groove 332, and in this embodiment, two sliding wheels 333 are disposed on the sliding base 331 on each side edge of the groove 332, which better facilitates the up and down sliding of the sliding base 331. As a further illustration, the inner side wall of the squeezing chamber 11 is provided with a track groove for the sliding assembly 33 to slide up and down. Such configuration better facilitates the up and down sliding of the sliding assembly 33. As a final illustration, an abutment plate 334 capable of abutting against a mop rod joint in the mop 2 is mounted in the groove 332. Such abutment plate 334 can cause the sliding base 33 to slide up and down in the track groove in the inner side wall of the squeezing chamber 11, or the abutment plate 334 can be disposed at a backside of the mop head of the mop 2, which realizes a wide variety of types and a wide range of choices.

Embodiment III: this embodiment can be illustrated on the basis of Embodiment I or Embodiment II. As shown in FIG. 2 and FIG. 5, the water pump 31 is provided with a water inlet end 311 and a water outlet end 312, the water inlet end 311 is located in the water storage chamber 12, a water channel 313 is disposed at the water outlet end 312, and the water channel 313 is communicated to the squeezing mechanism 4. Such configuration facilitates automatic water discharge during the cleaning process of the mop 2, and the mop 2 can be cleaned and dewatered synchronously. As a further illustration, the water channel 313 and the water storage chamber 12 are integrally molded, the water outlet end 312 of the water pump 31 is disposed at one end of the water channel 313, and the water channel 313 is communicated to the squeezing mechanism 4. Such configuration facilitates automatic water discharge during the cleaning process of the mop 2. In this embodiment, the water pump 31 is disposed on a lower end surface of the water storage chamber 12, and the water outlet end 312 is exactly located on the lower end surface of the water storage chamber 12, which facilitates better water intake of the water pump 31.

The retractor 32 is disposed on a lower end face of the squeezing mechanism 4, or the retractor 32 is disposed on a side wall of an upper port of the water storage chamber 12, or the retractor 32 is disposed between the lower end face of the squeezing mechanism 4 and the side wall of the upper port of the water storage chamber 12, which realizes a wide variety of types and a wide range of choices.

A connecting rod is adopted as the connecting rod member 34, which facilitates implementation.

Embodiment IV: this embodiment can be illustrated on the basis of Embodiment I or Embodiment II or Embodiment III. As shown in FIG. 1, FIG. 2, FIG. 6, and FIG. 7, the squeezing mechanism 4 includes an upper cover 21 disposed on the bucket body 1, the upper cover 21 is provided with a squeezing opening 22 and a squeezer 23, a waterway pipe 24 communicated to the water pump 31 is disposed on a lower surface of the upper cover 21, the upper cover 21 is provided with a water spraying part 25, and the water spraying part 25 is communicated to the waterway pipe 24. Such configuration is rational, and water squeezing can be achieved when the mop 2 is cleaned.

As shown in FIG. 2, the squeezing opening 22 has a width greater than that of the mop head of the mop 2, facilitating that cleaning and water squeezing can be operated through the up and down sliding of the mop head of the mop 2.

The squeezer 23 includes dense comb teeth and/or scrapers disposed on the upper cover 21 located on the squeezing opening 22, which is more conducive to achieving dewatering and decontamination effects.

As shown in FIG. 1 and FIG. 2, a cover plate 211 is disposed on the upper cover 21 above the squeezer 23, the water spraying part 25 is formed between the cover plate 211 and the squeezer 23, and the water spraying part 25 can spray water, which is conducive to achieving cleaning and water squeezing of the mop 2.

The upper cover 21 is provided with a handle 26 which is convenient for users to carry. Such configuration is more conducive to handling and moving the overall device by the users during use.

All standard parts used in this application document are commercially available, and specific connection modes of each part adopt the conventional means such as bolts and rivets that are mature in the prior art, which will not be specifically described herein.

It should be noted that although the above embodiments have been described herein, they are not intended to limit the scope of protection of the present invention patent. Therefore, based on the innovative ideas of the present invention, any changes and modifications made to the embodiments described herein, or equivalent structural or process transformations made using the content of the specification and accompanying drawings of the present invention, or direct or indirect application of the above technical solutions to other related technical fields, are all included in the scope of protection of the present invention patent.

What is claimed is:

1. A mop cleaning device, comprising a bucket body (1), wherein a squeezing chamber (11) and a water storage chamber (12) for cleaning or dewatering of a mop (2) are disposed in the bucket body (1), a squeezing mechanism (4) is disposed on the bucket body (1), a water supply mechanism (3) is disposed in the water storage chamber (12), the water supply mechanism (3) is communicated to the squeezing mechanism (4), wherein the water supply mechanism (3) comprises a water pump (31) disposed in the water storage chamber (12), a retractor (32) disposed on the squeezing mechanism (4), and a sliding assembly (33) disposed along an inner side wall of the squeezing chamber (11) in an up-and-down movement manner, the sliding assembly (33) is connected to the retractor (32), and the retractor (32) is connected to the water pump (31) through a connecting rod member (34), wherein the retractor (32) comprises a mounting base (321) disposed on a lower end face of the squeezing mechanism (4), a rotating arm (322) is disposed in the mounting base (321), the rotating arm (322) is provided with a spring rope (323), the spring rope (323) is wrapped around the rotating arm (322), the other end of the spring rope (323) is disposed on the sliding assembly (33), and the connecting rod member (34) is disposed on the rotating arm (322), wherein the squeezing mechanism (4) comprises an upper cover (21) disposed on the bucket body (1), the upper cover (21) is provided with a squeezing opening (22) and a squeezer (23), the upper cover (21) is provided with a water spraying part (25).

2. The mop cleaning device according to claim 1, wherein the rotating arm (322) comprises a rotating rod (3221) and a turntable (3222) disposed on an end face of the rotating rod (3221), the rotating rod (3221) is located in the mounting base (321), the turntable is located on an end face of the mounting base (321), and a fixing base for connecting the connecting rod member (34) is disposed on the turntable (3222).

3. The mop cleaning device according to claim 1, wherein a cylinder body (324) for mounting the rotating arm (322) is disposed between the mounting base (321) and the rotating arm (322), and the mounting base (321) and the cylinder body (324) are each provided with an access hole for the spring rope (323) to enter and exit.

4. The mop cleaning device according to claim 1, wherein the sliding assembly (33) comprises a sliding base (331) that is disposed on the inner side wall of the squeezing chamber (11) and can slide up and down, the spring rope (323) is fixedly connected to the sliding base (331), and the sliding base (331) is provided with a groove (332).

5. The mop cleaning device according to claim 1, wherein the water pump (31) is provided with a water inlet end (311) and a water outlet end (312), the water inlet end (311) is located in the water storage chamber (12), a water channel (313) is disposed at the water outlet end (312), and the water channel (313) is communicated to the squeezing mechanism (4).

6. The mop cleaning device according to claim 1, wherein a cover plate (211) is disposed on the upper cover (21) above the squeezer (23), and the water spraying part (25) is formed between the cover plate (211) and the squeezer (23).

7. The mop cleaning device according to claim 1, wherein the upper cover (21) is provided with a handle (26).

* * * * *